US010422203B2

(12) United States Patent
Stolboushkin et al.

(10) Patent No.: US 10,422,203 B2
(45) Date of Patent: Sep. 24, 2019

(54) SCREEN CONNECTION AREA ASSEMBLY FOR GRAVEL PACK AND METHOD

(71) Applicants: Eugene Stolboushkin, Houston, TX (US); Britain A. Fisher, Houston, TX (US); Christophe Malbrel, Houston, TX (US); Rajabov Vusal, Houston, TX (US)

(72) Inventors: Eugene Stolboushkin, Houston, TX (US); Britain A. Fisher, Houston, TX (US); Christophe Malbrel, Houston, TX (US); Rajabov Vusal, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 157 days.

(21) Appl. No.: 15/466,589

(22) Filed: Mar. 22, 2017

(65) Prior Publication Data

US 2018/0274340 A1 Sep. 27, 2018

(51) Int. Cl.
*E21B 43/08* (2006.01)
*E21B 43/04* (2006.01)

(52) U.S. Cl.
CPC ..... *E21B 43/045* (2013.01); *E21B 43/08* (2013.01)

(58) Field of Classification Search
CPC ..... E21B 43/04; E21B 43/08
See application file for complete search history.

(56) References Cited

U.S. PATENT DOCUMENTS 549,594 A * 11/1895 Jacobson et al. ..... F16L 55/172 138/99
3,226,143 A * 12/1965 Daughtrey ..... E21B 17/1028 166/173
5,379,836 A * 1/1995 Jordan ..... E21B 17/1035 166/241.6
5,787,980 A * 8/1998 Sparlin ..... E21B 43/088 166/231
6,405,800 B1 * 6/2002 Walker ..... E21B 43/08 166/235
6,752,207 B2 * 6/2004 Danos ..... E21B 17/02 166/227

(Continued)

OTHER PUBLICATIONS

Notification of Transmittal of the International Search Report and the Written Opinion of the International Searching Authority, or the Declaration; PCT/US2018/023597; dated Jul. 4, 2018; 10 pages.

*Primary Examiner* — Kipp C Wallace
(74) *Attorney, Agent, or Firm* — Cantor Colburn LLP

(57) ABSTRACT

A screen connection area assembly configured to mount between adjacent sand screens of a gravel pack string including a body attachable to a screen connection area between two adjacent sand screens of the gravel pack string, the body configured to displace fluid and present a radial dimension between about 75% and 100% of a radial dimension of the adjacent sand screens. A method for packing a gravel pack string including disposing an assembly as in any prior embodiment on a screen connection area between adjacent sand screens of the string, running the string into a borehole, supplying a slurry to the borehole proximate the sand screens, packing the sand screens and the screen connection area between adjacent sand screens without altering a flow regime of the slurry.

17 Claims, 5 Drawing Sheets

(56) References Cited

U.S. PATENT DOCUMENTS

| | | | | |
|---|---|---|---|---|
| 8,302,697 | B2 * | 11/2012 | Kuo | E21B 17/026 166/385 |
| 9,512,685 | B2 * | 12/2016 | Nguy | E21B 17/1035 |
| 9,562,402 | B2 * | 2/2017 | Vu | E21B 43/08 |
| 2003/0029613 | A1 | 2/2003 | Danos et al. | |
| 2003/0085038 | A1 | 5/2003 | Restarick et al. | |
| 2004/0065437 | A1 * | 4/2004 | Bostick, III | E21B 47/011 166/250.01 |
| 2010/0155064 | A1 * | 6/2010 | Nutley | E21B 33/1208 166/278 |
| 2010/0236779 | A1 * | 9/2010 | Nutley | E21B 17/1035 166/278 |
| 2012/0205095 | A1 | 8/2012 | Yeh et al. | |
| 2015/0218915 | A1 * | 8/2015 | Langlais | E21B 43/04 166/278 |
| 2016/0290109 | A1 | 10/2016 | Malbrel et al. | |

* cited by examiner

SCREEN CONNECTION AREA ASSEMBLY FOR GRAVEL PACK AND METHOD

BACKGROUND

In resource recovery endeavors for resources located in a subsurface environment, boreholes are drilled and then treated to a number of completion operations including but not limited to gravel packing operations. In a gravel packing operation, an interval of the borehole will be supplied with a number of sand screen joints. Each joint includes a portion thereof where a screen and a shroud are disposed radially outwardly of a holed base pipe. On either end of the screen and shroud, the base pipe (not holed) extends longitudinally for a short distance and ends in a threaded connection (the screen connection area). An adjacent screen joint may be connected to the first described joint at the threaded connection. Traditionally, after a string having two or more of these sand screen joints as a part thereof is run into the borehole, the interval of the borehole where the sand screen joints are located would be gravel packed. This process is old and well known to the industry and while such traditional operations have generally been viewed as successful, there is always a need for improvement in existing technology to enhance recovery and reduce equipment difficulties.

SUMMARY

A screen connection area assembly configured to mount between adjacent sand screens of a gravel pack string including a body attachable to a screen connection area between two adjacent sand screens of the gravel pack string, the body configured to displace fluid and present a radial dimension between about 75% and 100% of a radial dimension of the adjacent sand screens.

A method for packing a gravel pack string including disposing an assembly as in any prior embodiment on a screen connection area between adjacent sand screens of the string, running the string into a borehole, supplying a slurry to the borehole proximate the sand screens, packing the sand screens and the screen connection area between adjacent sand screens without altering a flow regime of the slurry.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

The inventors hereof have determined that in the screen connection area described above, gravel packing operations have been less than optimal. They have also determined that the reasons therefore revolve around the fluid flow dynamics within the slurry pumped into the borehole to gravel pack the interval when the flow encounters the screen connection areas.

Figure 1:
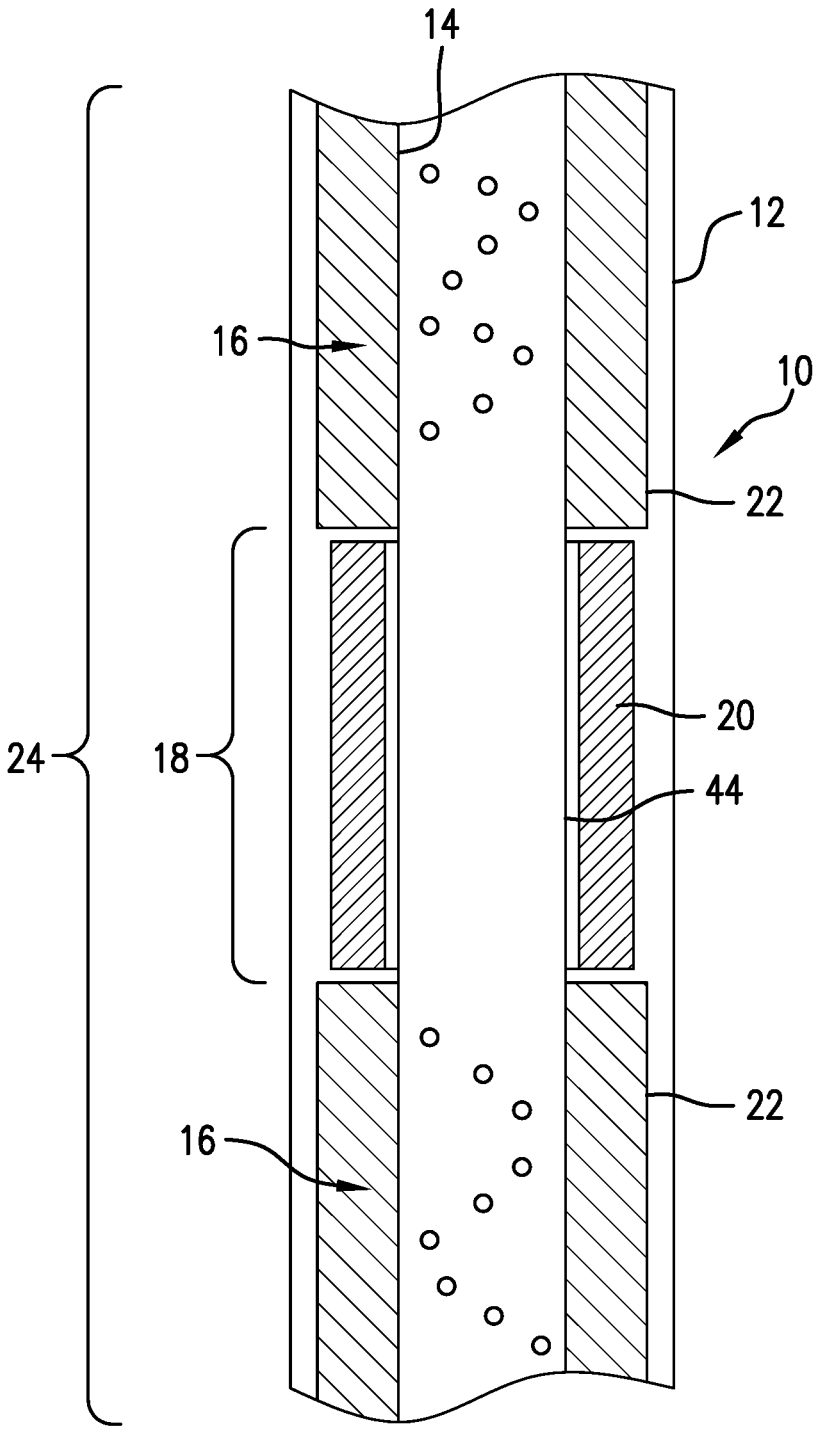
FIG. 1 is a schematic view of a borehole system in which two sand screen joints are shown.

Referring to FIG. 1, a borehole system 10 includes a borehole 12; a gravel pack string 14; having at least two sand screen joints 16; a screen connection area 18; and a screen connection area assembly 20.

Figure 2:
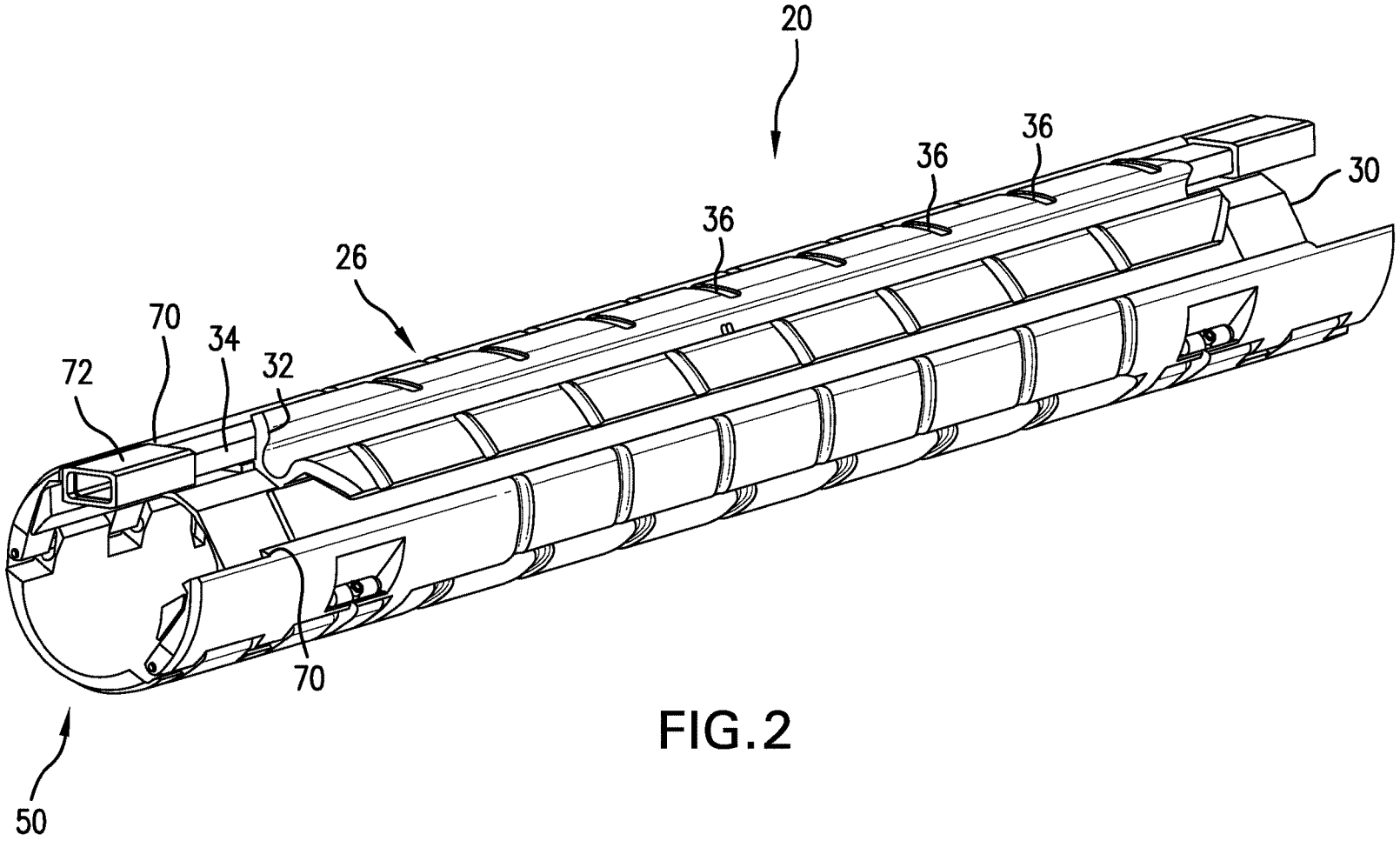
FIG. 2 is a perspective view of a screen connection area assembly for a gravel pack.

Referring to FIGS. 1 and 2, a screen connection area assembly 20 configured to mount between adjacent sand screens 22 of adjacent sand screen joints 16 all of a gravel pack interval 24.

The assembly 20 comprises a body 26 whose function it is to displace fluid of the slurry flow that when the assembly is in use is pumped around and passed the assembly. More specifically, it has been determined by the present inventors that flow regime inconsistencies of the slurry flow when it reaches screen connection areas 18 causes the gravel to pack poorly and results in suboptimal gravel pack properties. It has further been determined that displacing fluid volume about the connection areas 18 is expedient in maintaining a flow regime of the slurry with very similar if not identical properties as in areas directly radially outwardly of the sand screens 22. In an embodiment, desirable fluid displacement is achieved by disposing the assembly 20 as disclosed herein at the connection area 18, the assembly 20 having a radial dimension between about 75% and 100% of a radial dimension of the adjacent sand screen 22. In another embodiment, the radial dimension of the assembly 20 is between about 85% and 100% of the radial dimension of the adjacent sand screen 22. And in yet another embodiment the radial dimension of the assembly 20 is between about 95% and 100% of the radial dimension of the adjacent sand screen 22.

In embodiments, the radial dimensions of the assembly 20 are maintained for in excess of 324, 340 or 360 degrees of rotation about the assembly 20. In addition the radial dimensions are maintained in some embodiments for a minimum of 90% of a length of the screen connection area 18 whereas in other embodiments, the radial dimensions are maintained for a minimum of 95% of the length of the screen connection area 18. It is also to be appreciated that properties of any of the embodiments discussed are combinable with other properties of the assembly that are not mutually excluded.

Figure 5:
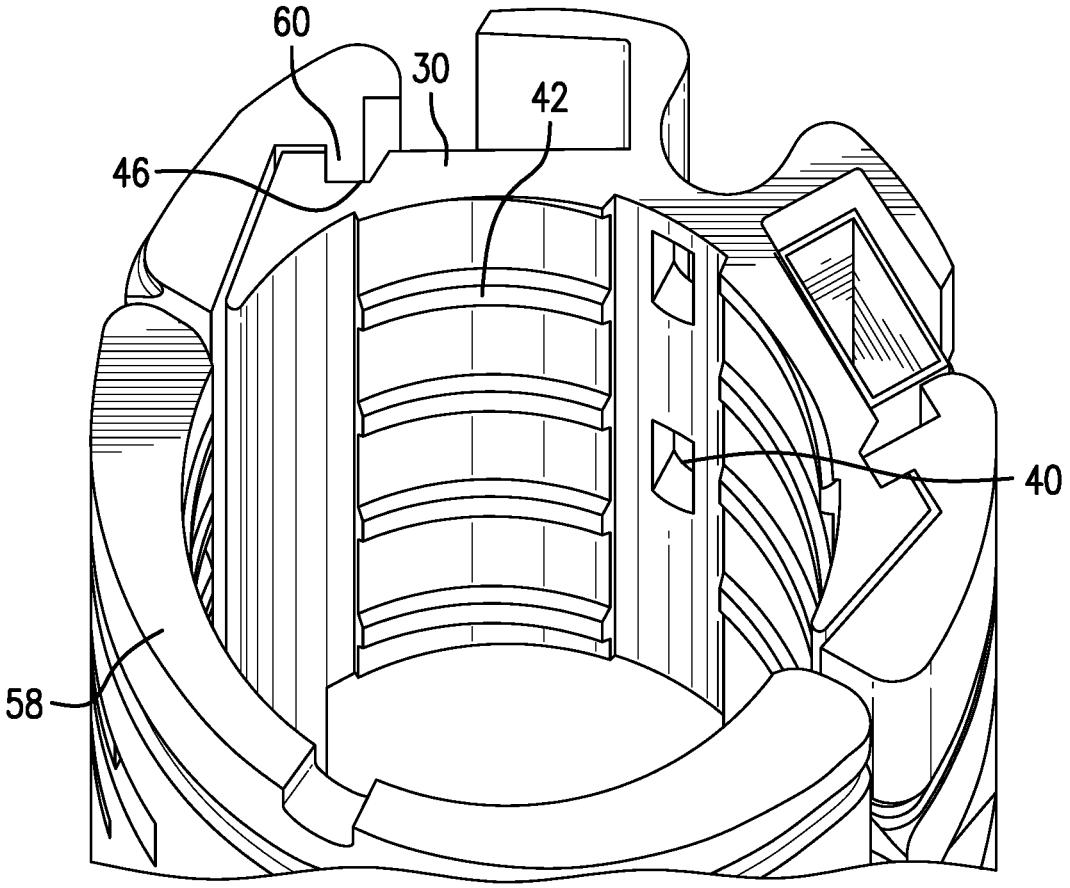
FIG. 5 is a perspective end view of the assembly.

In one embodiment, referring to FIGS. 2 and 5, the body 26 is configured in two major components: a tube carrier 30 and a backing 50. Tube carrier 30 comprises a hold down feature 32 configured to accept and hold two jumper tubes 34 (only one illustrated in each of FIGS. 2 and 5). Tube carrier 30 further exhibits grooves 36 on an outer surface thereof, each groove being positioned and dimensioned to encourage the leak off of hydrating fluid from the slurry to a leak off tube 38 (illustrated in FIG. 3). The grooves 36 may be of a number of possible patterns including annular, helical, waffle, etc. providing they provide for redundant axial, tangential and radial pathways for hydrating fluid to leak off to the leak off tube 38. There are additionally pathways 40 through the body 26 that allow for radial fluid movement toward the leak off tube 38. Some of these are visible in FIG. 5. Another feature of the tube carrier 30 is also visible in FIG. 5. This is a number of standoffs 42. These ensure the tube carrier 30 (and due to similar structures on the backing 50) stays spaced from the blank pipe 44 at the screen connection area 18 to promote fluid flow toward the leak off tube 38. Finally the tube carrier includes a lock recess 46 for engagement with a portion of the backing 50 discussed hereunder.

Figure 3:
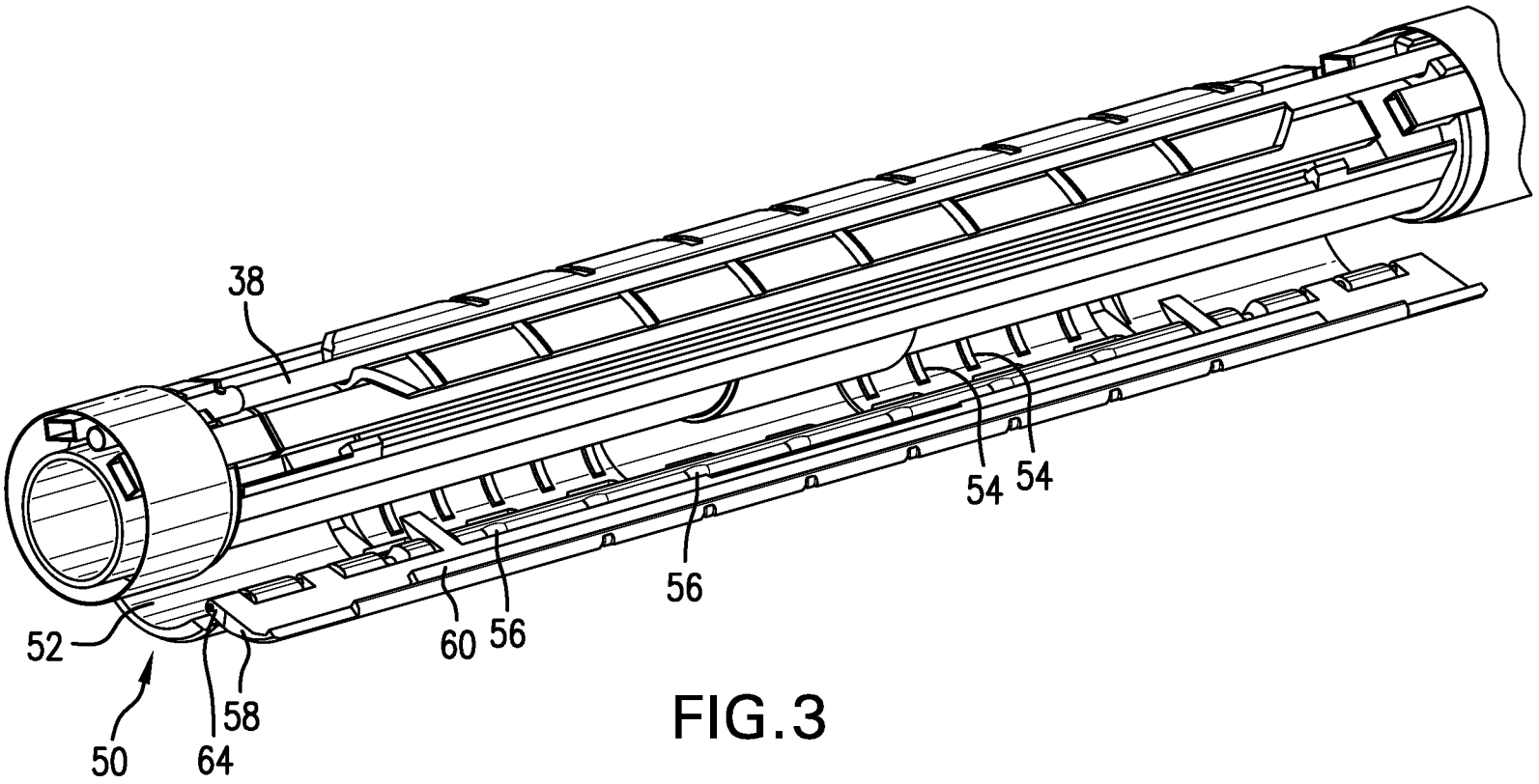
FIG. 3 is the assembly of FIG. 1 in an open position and disposed about a screen connection area.
Figure 4:
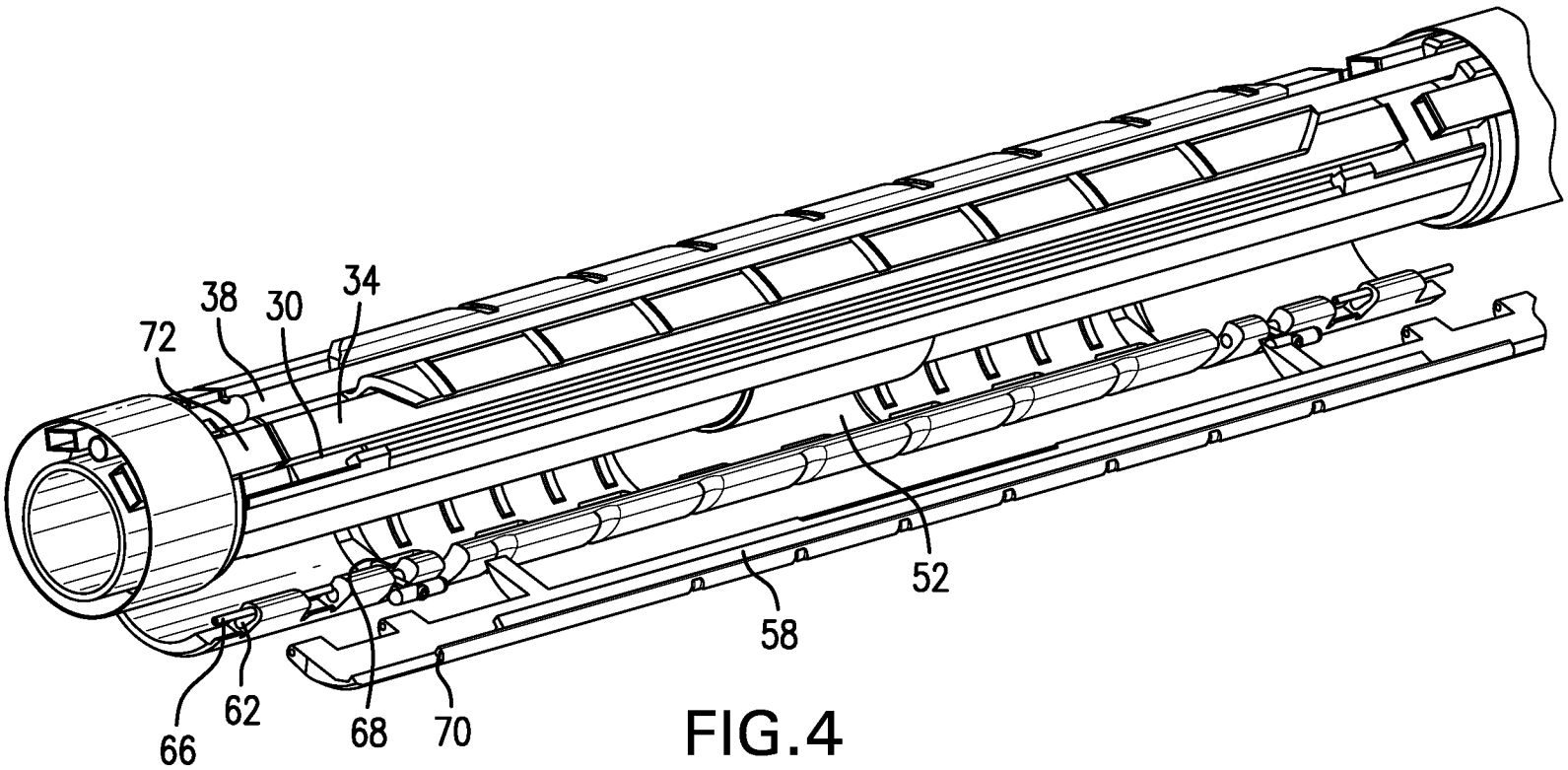
FIG. 4 is the view of FIG. 3 with one articulated flap exploded from the assembly.

Referring now to FIGS. 3 and 4, backing 50 is discussed in more detail. Backing 50 comprises backbone 52 and flaps 58. The backbone 52 includes standoffs 54 similar to standoffs 42 and with identical purpose and further includes grooves 56 similar to grooves 36, again with identical purpose. Flaps 58 are articulated to the backbone 52 to allow the backbone 52 to be assembled to the tube carrier 30. In an embodiment, the flaps 58 include a tongue 60 that is interactive with the lock recess 46. Referring again to FIG. 5, the tongue 60 can be seen engaged with the lock recess 46. This will also alert the astute reader to another feature of this embodiment. In order to allow the tongue to settle in the lock recess 46, the flap 58 would need to translate as well as pivot on the backbone 52. This motion is accounted for by a slot 62 in a hinge 64. It will be appreciated that although the slot is shown on the backbone side of the hinge 64, this could easily be transferred to the flap side of the hinge 64 without any loss of function. In either event, the slot 62 allows a pin 66 to translate as well as pivot so that the flap 58 may be moved in a rotating manner toward tube carrier 30 and in an extending manner to allow the tongue 60 to align with and settle in lock recess 46. Subsequent to engaging the tongue and lock recess, the flap 58 is secured back to the backbone 52 with a fastener 68, which in one embodiment is a threaded fastener.

Finally, the assembly 20 provides a locking feature in the form of a stop 70 for connector slides 72. Specifically, once a slide connector 72 is slid into connection with a slurry tube (not shown) in ways familiar to the art, the flap 58 is rotated into place thereby positioning the stop 70 as an obstruction to the slide connector 72 such that the slide connector 72 cannot move out of connection with the slurry tube (not shown).

A benefit of the assembly beyond its positive effect on gravel packing in screen connection areas 18 is that its form facilitates a degree of preassembly in that the tube carrier 30 may be fitted with jumper tubes 34 and slide connectors 72 in a manufactory or other off rig location to reduce time required on the rig. Preassembled as such, the tube carrier 30 with jumper tubes 34 and slide connectors 72 may be moved in one step onto a target screen connection area 18 and the slide connectors 72 slid into connection with slurry tubes (not shown). This action secures the tube carrier 30 and associated parts to the string 14 reliably for the time the backing 50 is being connected and secured. Time for completing connection of the entire assembly 20 to the string 14 is reduced and accordingly rig time is reduced, which is of great value to the industry.

Set forth below are some embodiments of the foregoing disclosure:

Embodiment 1

A screen connection area assembly configured to mount between adjacent sand screens of a gravel pack string including a body attachable to a screen connection area between two adjacent sand screens of the gravel pack string, the body configured to displace fluid and present a radial dimension between about 75% and 100% of a radial dimension of the adjacent sand screens.

Embodiment 2

The assembly as in any prior embodiment wherein the body further presents a circumferential continuity of the radial dimension for greater than about 324 degrees.

Embodiment 3

The assembly as in any prior embodiment wherein the body radial dimension is between about 85% and 100% of the radial dimension of the adjacent sand screens.

Embodiment 4

The assembly as in any prior embodiment wherein the body radial dimension is between about 95% and 100% of the radial dimension of the adjacent sand screens.

Embodiment 5

The assembly as in any prior embodiment wherein the assembly comprises a fluid impermeable material.

Embodiment 6

The assembly as in any prior embodiment wherein the assembly is hollow.

Embodiment 7

The assembly as in any prior embodiment wherein the body includes stand offs creating a flow gap between the body and a base pipe when in use.

Embodiment 8

The assembly as in any prior embodiment wherein the body includes leak off grooves.

Embodiment 9

The assembly as in any prior embodiment wherein the leak off grooves are helically arranged.

Embodiment 10

The assembly as in any prior embodiment wherein the body comprises a tube carrier and a backing, the backing configured to interengage the tube carrier.

Embodiment 11

The assembly as in any prior embodiment wherein the backing further includes an articulated flap.

Embodiment 12

The assembly as in any prior embodiment wherein the articulated flap is articulated at a hinge point that allows both rotation and translation.

Embodiment 13

The assembly as in any prior embodiment wherein the articulated flap includes a latching feature.

Embodiment 14

The assembly as in any prior embodiment wherein the articulated flap includes a securement.

Embodiment 15

The assembly as in any prior embodiment wherein the securement is a threaded fastener.

Embodiment 16

The assembly as in any prior embodiment wherein the articulated flap includes a stop configured and positioned to when closed prevent disengagement of a slide connector of a jumper tube.

Embodiment 17

A gravel packed string including two or more sand screen joints having sand screens thereon, an assembly as in any prior embodiment disposed between the sand screens of the two or more sand screen joints.

Embodiment 18

A method for packing a gravel pack string including disposing an assembly as in any prior embodiment on a screen connection area between adjacent sand screens of the string, running the string into a borehole, supplying a slurry to the borehole proximate the sand screens, packing the sand screens and the screen connection area between adjacent sand screens without altering a flow regime of the slurry.

Embodiment 19

The method as in any prior embodiment further including displacing slurry with the assembly.

Embodiment 20

A screen connection area assembly configured to mount between adjacent sand screens of a gravel pack string including a body attachable to a screen connection area of adjacent sand screens of a gravel pack string, the body configured to maintain a same flow cross section and area as does the adjacent sand screen.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A screen connection area assembly configured to mount between adjacent sand screens of a gravel pack string comprising:

a body attachable to a screen connection area between two adjacent sand screens of the gravel pack string, the body configured to displace fluid and present a radial dimension between about 75% and 100% of a radial dimension of the adjacent sand screens, the body comprising:

a tube carrier having a radially inward surface configured to nest with a base pipe and a radially outer surface having a hold down feature configured to accept a tube;

a backing having a radially inward surface configured to nest with the same basepipe; and a pair of flaps, one articulated to each of two sides of the backing and configured to fixedly interengage the tube carrier, the tube carrier, backing and pair of flaps together creating the body configured to wrap the base pipe.

2. The assembly as claimed in claim 1 wherein the body further presents a circumferential continuity of the radial dimension for greater than about 324 degrees.

3. The assembly as claimed in claim 1 wherein the body radial dimension is between about 85% and 100% of the radial dimension of the adjacent sand screens.

4. The assembly as claimed in claim 1 wherein the body radial dimension is between about 95% and 100% of the radial dimension of the adjacent sand screens.

5. The assembly as claimed in claim 1 wherein the assembly comprises a fluid impermeable material.

6. The assembly as claimed in claim 5 wherein the assembly is hollow.

7. The assembly as claimed in claim 1 wherein the body includes stand offs creating a flow gap between the body and a base pipe when in use.

8. The assembly as claimed in claim 1 wherein the body includes leak off grooves.

9. The assembly as claimed in claim 8 wherein the leak off grooves are helically arranged.

10. The assembly as claimed in claim 1 wherein the articulated flap is articulated at a hinge point that allows both rotation and translation.

11. The assembly as claimed in claim 1 wherein the articulated flap includes a latching feature.

12. The assembly as claimed in claim 11 wherein the articulated flap includes a securement.

13. The assembly as claimed in claim 12 wherein the securement is a threaded fastener.

14. The assembly as claimed in claim 1 wherein the articulated flap includes a stop configured and positioned to when closed prevent disengagement of a slide connector of a jumper tube.

15. A gravel packed string comprising:

two or more sand screen joints having sand screens thereon;

an assembly as claimed in claim 1 disposed between the sand screens of the two or more sand screen joints.

16. A method for packing a gravel pack string comprising:

disposing an assembly as claimed in claim 1 on a screen connection area between adjacent sand screens of the string;

running the string into a borehole;

supplying a slurry to the borehole proximate the sand screens;

packing the sand screens and the screen connection area between adjacent sand screens without altering a flow regime of the slurry.

17. The method as claimed in claim 16 further including displacing slurry with the assembly.

* * * * *